United States Patent [19]

Jencks

[11] 4,035,846

[45] July 19, 1977

[54] INFLATABLE PRESSURE COMPENSATED HELMET STABILIZATION SYSTEM

[75] Inventor: Craig S. Jencks, Fountainville, Pa.

[73] Assignee: The United States of America as represented by the Secretary of the Navy, Washington, D.C.

[21] Appl. No.: 715,039

[22] Filed: Aug. 17, 1976

[51] Int. Cl.[2] ..... A42B 3/02

[52] U.S. Cl. ..... 2/413; 2/6

[58] Field of Search ..... 2/411–416, 2/6

[56] References Cited

U.S. PATENT DOCUMENTS

| | | | |
|---|---|---|---|
| 3,310,811 | 3/1967 | Jacono | 2/6 |
| 3,600,714 | 8/1971 | Cade et al. | 2/413 |
| 3,761,959 | 10/1973 | Dunning | 2/413 |
| 3,806,950 | 4/1974 | Spencer-Foote | 2/413 |

FOREIGN PATENT DOCUMENTS

| | | | |
|---|---|---|---|
| 1,378,494 | 12/1974 | United Kingdom | 2/414 |

*Primary Examiner*—Alfred R. Guest

*Attorney, Agent, or Firm*—R. S. Sciascia; Henry Hansen

[57] ABSTRACT

An inflatable stabilization system located within a rigid helmet shell. The system is constructed of an inflatable bladder having a manifold located in the nape area of the helmet with four curved ducts branching off to extend forwardly over the occipital and crown areas of the wearer. The bladder is attached to the helmet shell by hook and pile fastener strips. A pressure difference sensor controls bladder pressure to maintain a desired pressure difference between the bladder and ambient pressure. When a cloth hat or liner is used with the helmet, the bladder is located between the hat and the helmet shell.

5 Claims, 6 Drawing Figures

FIG. 6.
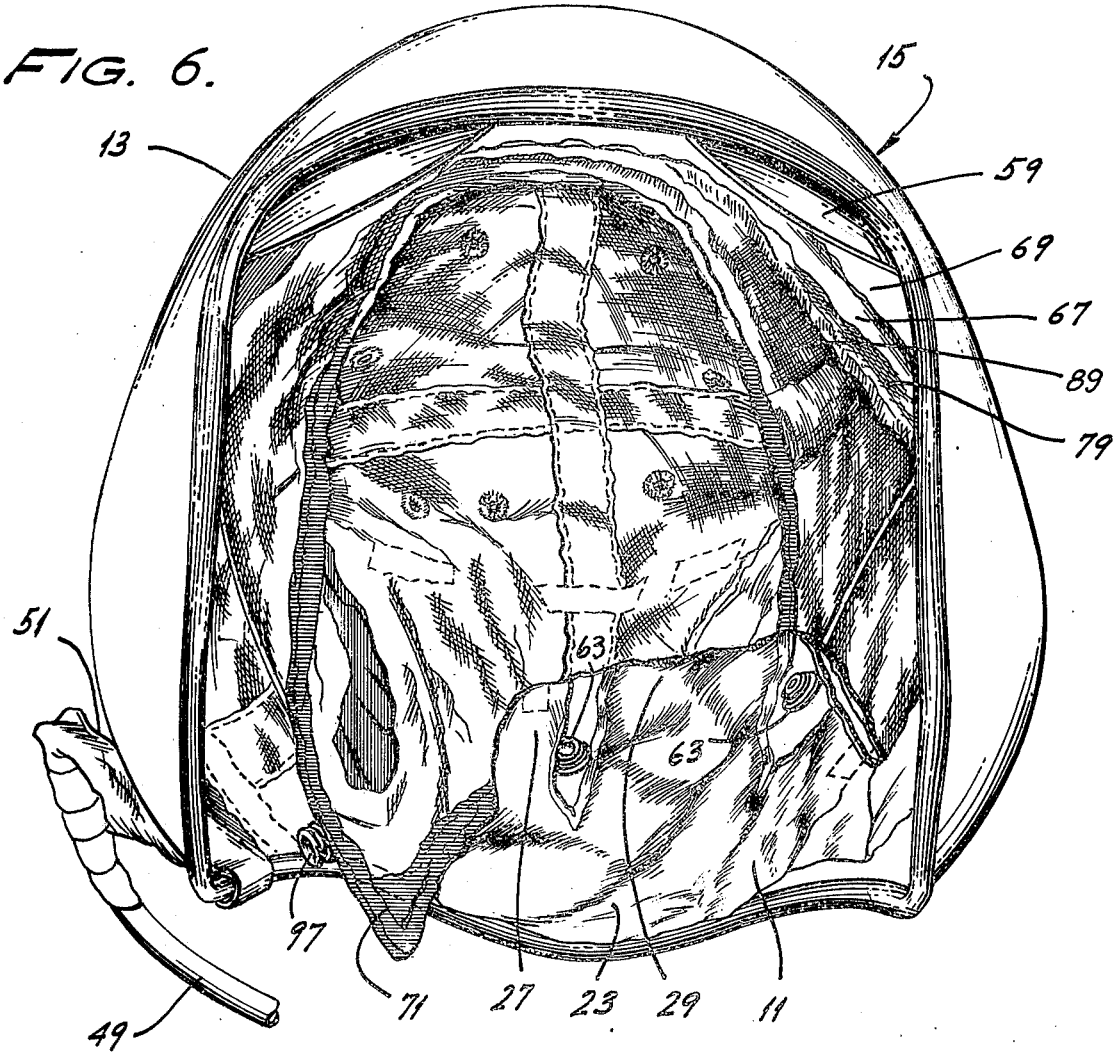
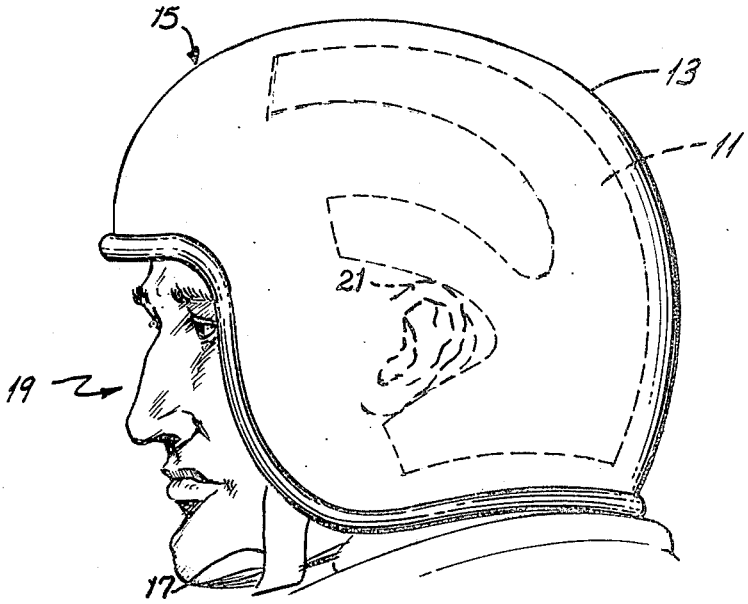
FIG. 1.

FIG. 2.
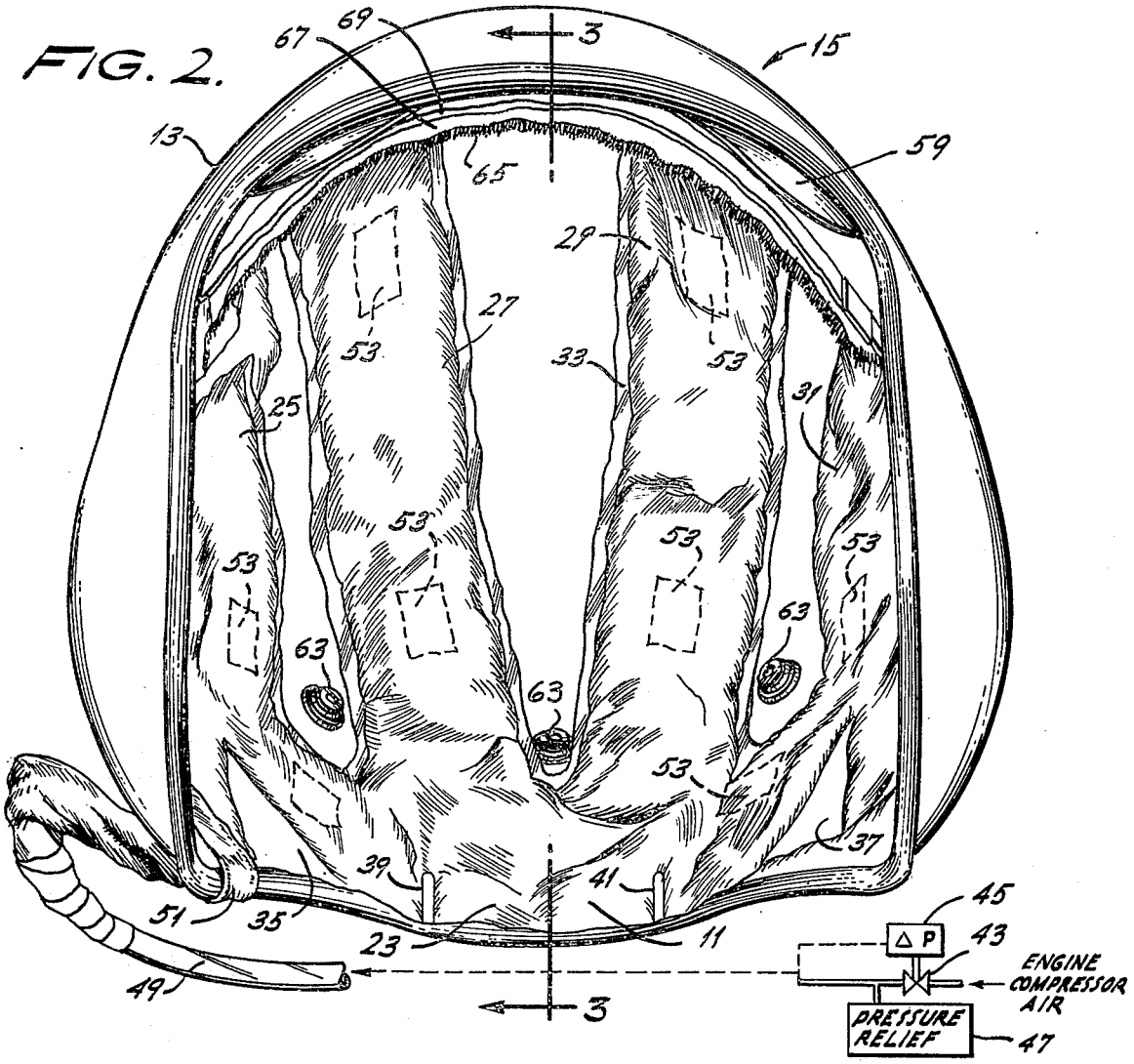
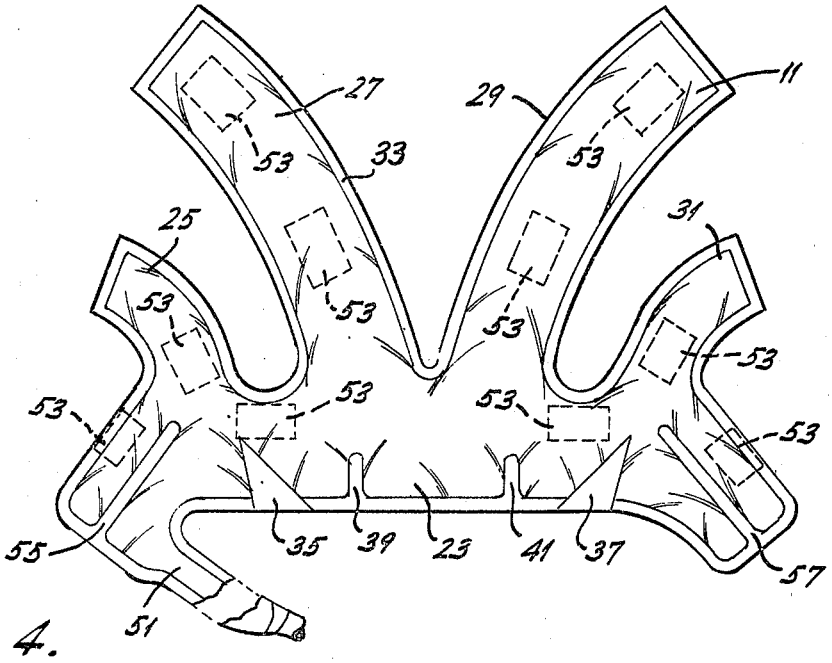
FIG. 4.

INFLATABLE PRESSURE COMPENSATED HELMET STABILIZATION SYSTEM

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

The present invention relates to protective helmets, and more particularly to a device for stabilizing a protective helmet on the wearer's head.

Various suspension systems, some including inflatable padding, have been used to provide shock protection and fit in protective helmets. While such devices have served the purpose, they have not proven entirely satisfactory because there is still a tendency for the helmet to shift on the head of the wearer. The elimination of the motion of the helmet shell relative to the wearer's head is critical in some applications such as VTAS (Visual Target Acquisition System). VTAS is a helmet mounted aircraft weapon control system wherein the missile radar system is controlled by the pilot's line of sight so that radar acquisition, lock-on, and missile firing are done visually. This is accomplished by computing the pilots's line of sight by using sensors mounted in the helmet shell. If the helmet shell shifts relative to the pilot's head during air combat maneuvers or under high acceleration, the radar system is no longer attuned to the pilot's line of sight and the system becomes ineffectual. Thus, there is a need for a device or system capable of stabilizing and rigidizing a helmet on the head of the wearer. Furthermore, for those helmet suspension systems including inflatable padding, such padding is generally designed to maintain a constant pressure within the padding. If such padding is used by an aircrewman, the volume of the padding, as the cabin ambient pressure varies with altitude, will also vary.

SUMMARY OF THE INVENTION

Accordingly, it is the general purpose of the invention to provide a helmet stabilization system capable of stabilizing a protective helmet on the wearer's head and suitable for use by an aircrewman.

Other objects of the present invention are to provide a helmet stabilization system which can properly align and rigidize the helmet on the wearer's head, which permits use of helmet-controlled systems requiring a helmet which will not shift relative to the wearer's head, which can cooperate with a helmet shock protection and sizing system, which maintains comfort, fit and cooling while improving impact and buffet protection and which improves suspension system fit.

A further object of the present invention is to provide an inflatable helmet stabilization system which is capable of maintaining a constant pressure difference between the pressure of the inflatable portion of the system and the ambient cabin air pressure.

Still further objects of the present invention are to provide a helmet stabilization system which does not space the helmet substantially from the wearer's head, thus permitting a low helmet profile, which will not obstruct the wearer's range of vision, and which will permit free operation of a visor assembly located beneath the helmet shell.

Briefly, these and other objects are accomplished by an inflatable bladder disposed within and releasably fastened to the shell of the helmet. The bladder is releasably fastened to the helmet shell by hook and pile fastener strips. Where a cloth hat or other suspension is not used with the helmet, the bladder opposes the forces imposed on the wearer's head by the helmet chin strap. When a cloth hat or liner or other suspension is used within the helmet, the bladder occupies the space between the helmet shell and the suspension. The bladder comprises a manifold and four ducts. The manifold is located in the nape area of the helmet, with the ducts branching off to extend forwardly over the occipital and crown areas of the wearer's head. When inflated, the bladder restricts motion of the shell relative to the head, so that the helmet is held rigid with respect to the wearer's head. The inflating air supplied to the bladder passes through a pressure compensating valve by which bladder pressure is controlled to maintain a desired pressure difference between the bladder and ambient pressure. As altitude increases, ambient pressure decreases and the bladder is proportionally deflated to compensate. Similarly, as altitude decreases, ambient pressure increases and the bladder is proportionally inflated to compensate therefor.

Other objects, advantages and novel features of the invention will become apparent from the following detailed description of the invention when considered in conjunction with the accompanying drawings wherein:

BRIEF DESCRIPTION OF THE DRAWINGS

FIG. 1 is a side view of a helmet stabilized according to the present invention on the head of the wearer, showing the relative position of the inflated bladder of the present invention in the helmet;

FIG. 2 is a bottom view of the helmet of FIG. 1 and stabilization system according to the invention;

FIG. 4 shows a plan view of the bladder of FIG. 1;

FIG. 6 is a bottom view of the helmet of FIG. 1 with the cloth hat of FIG. 5 installed therein with portions of the cloth cut away.

DESCRIPTION OF THE PREFERRED EMBODIMENT

Figure 3:
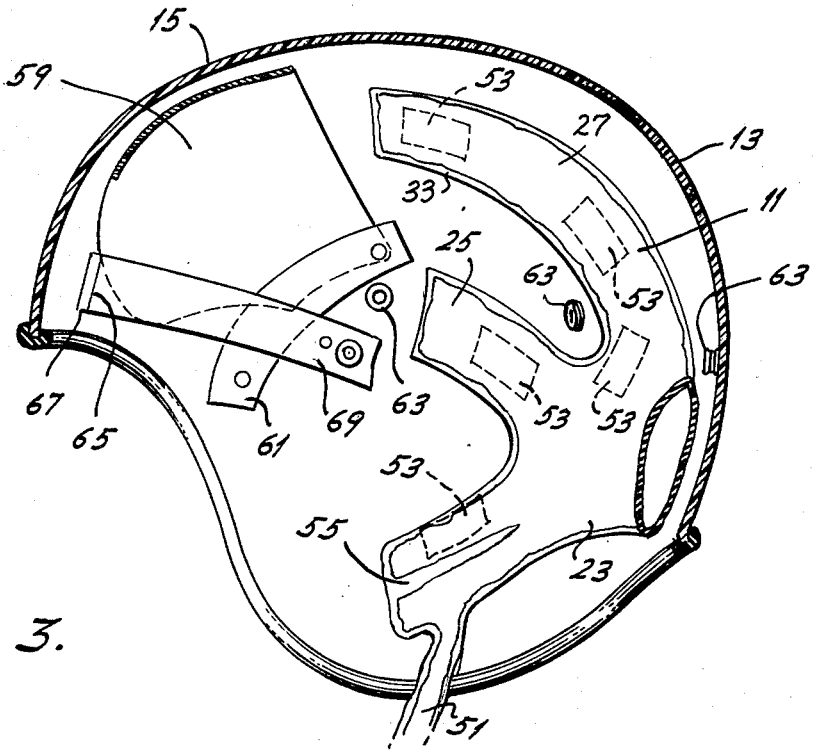
FIG. 3 shows a section of the helmet taken on the line 3—3 of FIG. 2.

Referring now to the drawings, wherein like reference characters designate like or corresponding parts throughout the several views, there is shown in FIG. 1 a bladder 11 disposed beneath the helmet shell 13 of a helmet 15 having a chin strap 17 and disposed on the head of the wearer 19. Bladder 11 is configured to extend over and support the wearer's head 19 along a plurality of lines while conforming to the inside surface of helmet shell 13. Bladder 11 is configured to avoid the wearer's ear 21 for a more comfortable fit.

Bladder 11 is shown in greater detail in FIGS. 2 and 4. Bladder 11 comprises a maniflod 23 and four curved ducts 25, 27, 29 and 31 branching off and extending from the same edge of the manifold. The curvature of ducts 25, 27, 29 and 31 permits them to more readily conform to the curvature of helmet shell 13 and to extend forwardly along the shell. Bladder 11 is preferably constructed with two appropriately cut sheets of flat material placed one on top of the other and sealed together with a seal 33 running along the edges of the bladder, the material and seal being capable of being inflated and pressurized with insignificant leakage. For example, these two cut sheets can be of a lightweight coated nylon fabric, and seal 33 can be formed by a heat-seal process such as ultrasonic or dielectric, or by cementing the sheets together, or by other methods. Triangles 35 and 37 and seal lines 39 and 41, which can be formed in a manner similar to that for seal 33, and can be formed at the same time, enable manifold 23 to bend while inflated, to allow it to conform to the shape of helmet 15 in which it is inserted, as shown in FIG. 2. The inflation of bladder 11 is accomplished by supplying pressurized air, such as bleed air from the aircraft engine compressor, to shutoff valve 43, which is controlled and turned on or shut off by pressure difference sensor 45. Pressure difference sensor 45 senses the difference between the bladder 11 pressure and the ambient pressure, and turns on valve 43 to admit engine compressor air to the bladder, when the bladder 11 pressure is too low with respect to the ambient pressure. Otherwise, sensor 45 keeps valve 43 shut off. If bladder 11 pressure is too large with respect to the ambient pressure, pressure relief valve 47 is used to reduce bladder pressure to an acceptable level. Initially, bladder 11 pressure is at or near zero, so that sensor 45 will open valve 43, permitting engine compressor air to pass through valve 43 and inflate bladder 11. Inflation of bladder 11 is accomplished by the introduction of air from valve 43 passing through air supply tube 49 into bladder tube 51 and thence to manifold 23. Manifold 23 is positioned in the nape of helmet 15, providing a convenient, effective location for the entry of engine compressor air from outside the helmet to bladder 11 which furthermore does not interfere with any other systems which communicate with the helmet. Manifold 23 then provides the engine compressor air to inflate ducts 25, 27, 29 and 31, and together with the ducts stabilizes helmet 15 on the wearer's head 19.

Bladder 11 can be used in combination with a cloth hat or liner 71, as shown in FIG. 6. In this configuration, bladder 11 is positioned between shell 13 and hat 71, and is inflated only sufficiently to occupy the space remaining between the shell and the hat while helmet 15 is worn in order to stabilize and rigidize the helmet on the wearer's head 19. Bladder 11 can also be used to stabilize helmet 15 when cloth hat 71 is not used, provided that chin strap 17 is attached directly to the helmet. As shown in FIG. 1, bladder 11 is configured and positioned in helmet 15 so as to oppose the forces imposed by chin strap 17 on helmet 15 and on the wearer's head 19, and to prevent relative motion of shell 13 relative to the wearer's head, so that helmet 15 is held rigid with respect to the wearer's head. Again, only a limited inflation of bladder 11 would be required to occupy the space between shell 13 and wearer's head 19 and to stabilize helmet 15 on the wearer's head 19. Because of the limited inflation needed in both situations, and the flat shape of bladder 11, bladder 11 spaces helmet 15 away from the wearer's head 19 only to a minimal extent while stabilizing the helmet on the head of the wearer. This limited spacing results in a low helmet profile, which increass or at least only minimally restricts the wearer's range of vision, particularly when used in an aircraft.

To maintain the proper stabilization, once bladder 11 has been initially appropriately inflated, the inflated size of the bladder should not vary. However, if helmet 15 is worn in an aircraft, the ambient pressure will vary with aircraft altitude, so that bladder 11 could expand or retract, if its pressure is held constant, as the altitude increases or decreases. In order to prevent this effect, the pressure within bladder 11 must vary with the ambient pressure, so that the pressure difference between the pressure within the bladder and the ambient pressure is held constant. Maintenance of such a constant pressure difference is accomplished by placing valve 43, pressure difference sensor 45 and pressure relief valve 47 on pressurized air supply tube 49 to regulate the flow of air into and out of bladder 11.

Once bladder 11 has been initially inflated, via tube 49, pressure difference sensor 45 senses the difference between bladder pressure and ambient pressure, and permits the flow of air to bladder 11, as needed to maintain a constant pressure difference. Simultaneously, pressure relief valve 47 compares ambient pressure with bladder 11 pressure, and permits release of air from bladder 11 when the bladder pressure is too much greater than the ambient pressure. Although head sizes vary from individual to individual, this only means that there are different desired bladder 11 volumes, not pressures or pressure differences, for different wearers. The desired difference between bladder 11 pressure and ambient pressure does not vary with the wearer, since bladder 11 is only intended to take up the space between shell 13 and wearer's head 19, or between shell 13 and hat 71 if the hat is used. Accordingly, sensor 45 and valve 47 can be preset to the desired pressure difference for bladder 11, which can for example be $\frac{1}{4}$ pound per square inch, or $\frac{1}{2}$ pound per square inch, above the ambient pressure.

In use, bladder 11 is disposed on the inside surface of helmet shell 13 of helmet 15 as shown in FIGS. 1, 2, 3, and 6. The upper surface of bladder 11 and the inside surface of shell 13 are provided with a plurality of matching pairs of hook and pile fastener strips 53 which can, for example, be of Velcro. Fasteners 53 are used to firmly but releasably attach bladder 11 to the underside of helmet shell 13. Bladder 11 is disposed inside helmet shell 13 so that manifold 23 is located in the nape area of helmet 15 and ducts 25, 27, 29 and 31 extend forwardly over the occipital and crown areas of the wearer's head 19. As has been discussed above, bladder 11 is configured to conform to the inside surface of helmet shell 13 when inflated or uninflated. Where manifold 23 comes closest to the ears of the wearer, its thickness is there reduced for comfort, while still providing adequate stabilization, by means of seal lines 55 and 57. Seal lines 55 and 57 can be formed in a manner similar to that for seal 33, and can be formed at the same time as seal 33. As shown in FIG. 3, bladder 11 is so configured that no part of the bladder, particularly ducts 25, 27, 29 and 31, interferes with the free movement of visor 59 on visor track 61 (the other visor track is not shown in this view) so that the position of visor 59 can be readily adjusted as desired by the wearer.

Figure 5:
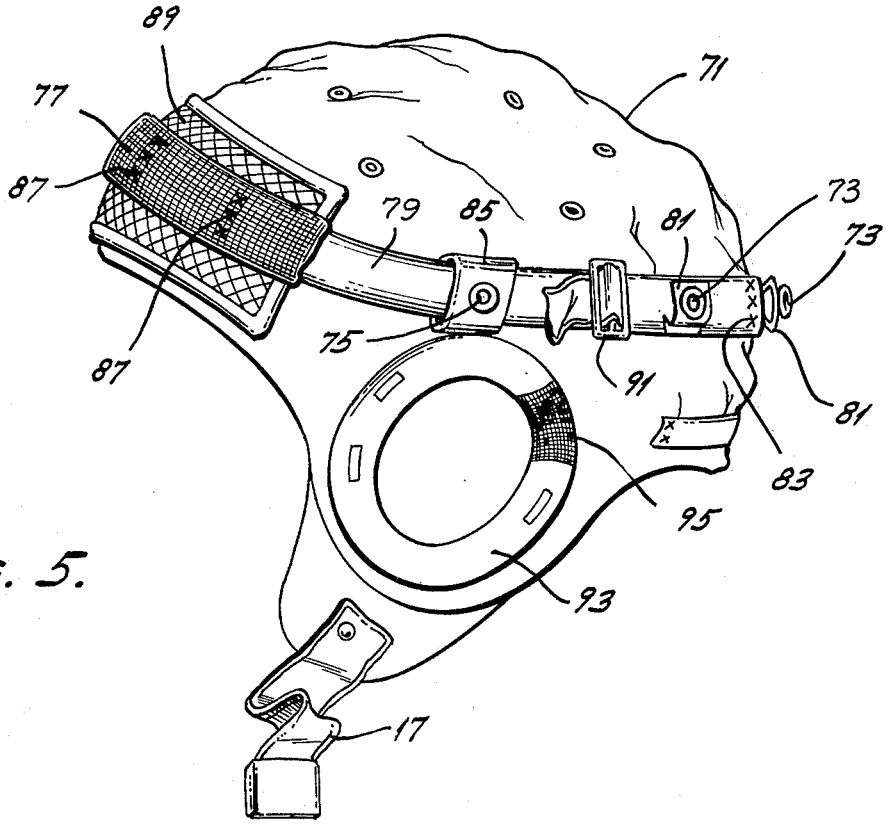
FIG. 5 illustrates a side elevation of a cloth hat or liner usable with the helmet of FIG. 1.

As shown in FIGS. 2 and 3, the inside surface of helmet shell 13 is provided with a plurality of snap fasteners 63 arranged along a line running along the sides and back of helmet shell 13. Helmet shell 13 is also provided with a hook and pile fastener strip 65 which is fixed to padding 67 attached to a curved strip 69 which has some flexibility and can be of metal. Cloth hat or liner 71 for use in helmet 15 is shown in FIG. 5, with *x* marks used to designate seams. As shown in FIG. 5, cloth hat or liner 71 is provided with a plurality of snap fasteners 73 on the rear of the hat and a plurality of snap fasteners 75 on the sides of the hat (only one such fastener shown in this view), which fasteners mate with snap fasteners 63 on helmet shell 13 to releasably fasten hat 71 to helmet shell 13. Also, the front of hat 71 is provided with a hook and pile fastener strip 77 which mates with hook and pile fastener strip 65 in helmet 15 to releasably fasten hat 71 therein. Rear snap fasteners 73 are fixed to adjustable head strap 79, which can be of cloth, and to cloth hat 71 by cloth loops 81 on which rear snap fasteners 73 are mounted. Cloth loops 81 are sewn onto head strap 79. Head strap 79 can be sewn directly onto hat 71 by seam 83, or the strap can be attached to and spaced from the hat by means of cloth loop 81. Side snap fastener 75 (the other side snap fastener is not shown in this view) is mounted on cloth loop 85 which is sewn onto hat 71 but not onto head strap 79, which passes freely between loop 81 and hat 71, so that the size of head strap 79 can be adjusted. Hook and pile fastener strip 77 is fixed to head strap 79, which in turn is attached by seams 87 to padding or comfort liner 89 which in turn is fixed to the front of hat 71. Padding 67, curved strip 69 and padding 89 provide cushioning for the frontal part of the wearer's head. The size of adjustable head strap 79, and thus of hat 71, can be adjusted by means of buckle 91 (a similar buckle on the other side of hat 71 is not shown in this view). Cloth hat 71 is formed with an earpiece 93, which can be of cloth, on each side (only one earpiece being shown in this view) to accommodate earphones. Each such earpiece 93 has a hook and pile fastener pair 95 for opening and closing the corresponding earpiece about an earphone. As shown in FIG. 6, cloth hat 71 also has a snap fastener 97 to which the free end of chin strap 17 can be attached. Bladder 11 itself provides additional impact and buffet protection to the wearer's head, while the comfort, fit and cooling provided by hat 71 are maintained.

In summary, bladder 11 is releasably fastened to the inside of helmet shell 13 by hook and pile fasteners 53, and can be used to stabilize helmet 15 on the wearer's head 19 with or without use of a cloth hat or liner 71. Pressure difference sensor 45 controls valve 43 and thus inflation of bladder 11, thereby maintaining a constant pressure difference between bladder pressure and ambient pressure, by opening valve 43 to admit inflating air to the bladder whenever the bladder pressure is not sufficiently greater than the ambinet pressure, and shutting off valve 43 otherwise. Should the bladder 11 pressure be too much greater than the ambient pressure, pressure relief valve 47 is opened to release inflating air from bladder 11. If a cloth hat 71 is not used, bladder 11 is configured to oppose the force exerted by chin strap 17, which is attached to helmet 15, on the wearer's head 19. If a cloth hat 71 is used, bladder 11 is expanded sufficiently to occupy the space between hat 71 and shell 13, while a plurality of fasteners 63, 65, 73, 75 and 77 also help to hold hat 71 rigid in helmet 15. In this manner, bladder 11 effects the stabilization and rigidization of helmet 15 on the wearer's head 19.

It should be understood that this invention is not limited to use as an aviators's helmet. Helmet 15 is also usable as a safety helmet for general applications, and can be used by miners, racing car drivers, and others, particularly where there is a need for a helmet which is rigidized on the wearer's head. Also, a different pressurized or inflating fluid other than engine compressor air can be used to inflate bladder 11. In addition, different fasteners and arrangements of fasteners can be used other than those described above for fastening bladder 11 to helmet shell 13 and for fastening cloth hat 71, where used, to helmet shell 13. The specific arrangement of fasteners 53, 63, 65, 73, 75 and 77 shown in the several views can be varied and need not always be followed or used. Hat 71 can be releasably fastened to the underside of bladder 11, using hook and pile fasteners or other fastening means, to provide a more positive interconnection between hat 71 and shell 13 when bladder 11 is inflated. Furthermore, bladder 11 can be used in combination with other helmet suspension or fitting devices than cloth hat 71. Also, valve 43, controlled by sensor 45, could be configured to both admit and release inflating fluid from bladder 11 according to the variation from the set pressure difference, so that pressure relief valve 47 could be dispensed with.

Thus there has been provided a novel inflatable pressure-compensated helmet stabilization system capable of stabilizing a protective helmet on the wearer's head and suitable for use by aircrewmen and others. This system properly aligns and rigidizes the helmet on the wearer's head, and permits use of helmet-controlled systems which require a helmet which will not shift relative to the wearer's head. The system can cooperate with a helmet shock protection and sizing system, maintaining comfort, fit and cooling while improving impact and buffet protection and improving fit. In addition, a constant pressure difference between the pressure of the inflatable portion of the system and the ambient cabin air pressure can be maintained, thereby preventing fluctuations in volume of that portion and discomfort and variations in stabilization that could result, under substantial variations in ambient pressure from changes in altitude. Because of the flat shape of the bladder and the limited inflation needed for stabilization, any spacing of the helmet from the wearer's head by the bladder is minimal so that a low helmet profile is permitted, and the wearer's range of vision is not obstructed. Furthermore, this system permits free operation of a visor assembly which is located beneath the helmet shell.

Obviously many modifications and variations of the present invention are possible in light of the above teachings. It is therefore to be understood that within the scope of the appended claims, the invention may be practiced otherwise than as specifically described.

What is claimed is:

1. A helmet stabilization system, comprising:

a helmet shell;

a chin strap secured at each end to said shell for pressing the head of the wearer in said shell;

an inflatable member disposed within said shell for opposing the forces imposed on the head of the wearer by said chin strap;

a first plurality of fasteners releasably fastening said member to within said shell;

a source of pressurized fluid; and pressure compensating valve means operatively connected between said source and said member for passing the pressurized fluid therethrough according to the variation from a preset value of the pressure difference between that of said member and the ambient pressure.

2. A helmet stabilization system, comprising:

a helmet shell;

an inflatable member disposed within said shell;

a suspension disposed adjacent to said member;

a first plurality of fasteners releasably fastening said member to said shell;

a second plurality of fasteners releasably fastening said suspension to said shell;

a source of pressurized fluid; and pressure compensating valve means operatively connected between said source and said member for passing the pressurized fluid therethrough according to the variation from a preset value of the pressure difference between that of said member and the ambient pressure.

3. A helmet, comprising:

a helmet shell;

an inflatable member disposed within said shell; and pressure compensating means connected to said member for maintaining a constant pressure difference between the pressure within said member and the ambient pressure.

4. A helmet as defined in claim 3 wherein said pressure compensating means comprises:

a first valve formed to receive pressurized fluid and connected to said member; and pressure difference sensing means connected to said first valve for operating said first valve according to the variation from a first preset value of the pressure difference between the pressure within said member and the ambient pressure.

5. A helmet as defined in claim 4 wherein said pressure compensating means further comprises:

pressure relief valve means connected to said member for maintaining the difference between the pressure within said member and the ambient pressure below a second preset value.

* * * * *